US005560066A

United States Patent [19]

McDivitt

[11] Patent Number: 5,560,066

[45] Date of Patent: Oct. 1, 1996

[54] PORTABLE GOLF CLUB CLEANER

[76] Inventor: Mark W. McDivitt, 4013 Bacon, Berkley, Mich. 48072

[21] Appl. No.: 439,293

[22] Filed: May 11, 1995

[51] Int. Cl.[6] ..... A47L 25/00; A46B 13/04

[52] U.S. Cl. ..... 15/88.3; 15/21.1

[58] Field of Search ..... 15/21.1, 88.2, 15/88.3, 97.1, 24, 77

[56] References Cited

U.S. PATENT DOCUMENTS

| | | | |
|---|---|---|---|
| 3,081,471 | 3/1963 | Newell | 15/88.3 |
| 3,148,396 | 9/1964 | Smith | 15/88.3 |
| 3,332,099 | 7/1967 | Reiter | 15/21.1 |
| 3,619,841 | 11/1971 | Russell et al. | 15/21.1 |
| 5,402,549 | 4/1995 | Forrest | 15/77 |

*Primary Examiner*—Frankie L. Stinson
*Assistant Examiner*—Randall E. Chin
*Attorney, Agent, or Firm*—Renner, Kenner, Greive, Bobak, Taylor & Weber

[57] ABSTRACT

A portable golf club cleaner has a rotatable brush and a recirculating pump powered by a power supply, and an activation switch such that whenever a club face comes in contact with the rotatable brush, a motor rotates the brush while the recirculating pump provides a cleansing spray of cleaning solution to the club face. Furthermore, the portable golf club cleaner is constructed such that the cleaning solution is recirculated through a filter and into a reservoir so as to effectively clean golf club faces for an entire round of golf. The portable golf club cleaner also has a detachable front cover so that the club face of larger clubs, such as woods and drivers can also be cleaned without difficulty.

14 Claims, 4 Drawing Sheets

PORTABLE GOLF CLUB CLEANER

TECHNICAL FIELD

The invention herein resides generally in the art of devices for cleaning golf clubs. More particularly, the present invention relates to an apparatus for cleaning a club face where a brush is rotated on the club face while a cleaning solution is sprayed onto the club face. Specifically, the present invention relates to a compact, battery operated apparatus for cleaning golf clubs, wherein the brush is rotated and a cleaning solution is sprayed when the club face is in contact with the brush.

BACKGROUND ART

In the game of golf, it is very important for the club face of a golf club to be clean and free from dirt, grass and the like. In particular, it is important that the grooves on the club face be free of foreign matter before the club face makes contact with the golf ball. These grooves in the club face help the golfer to maintain directional accuracy and/or attain a top spin or back spin on the golf ball as desired. It is also important for the golf club face to be clean from any dirt or grass in that this foreign matter reduces the impact force of a golf club hitting the golf ball, thereby reducing the amount of distance a ball will travel. Another reason for keeping club faces clean is to prevent rusting or pitting. This, of course, helps to maintain the value of the golf club or clubs, thereby maintaining their resale value and their longevity.

Current methods of maintaining a clean club face range from using a wet towel and cleaning the club face after each time the club is used, or scraping the club face with a golf tee. Another method of keeping a club face clean is to use a carbide-tipped scraper after each use of the club. Unfortunately, the above described methods have several drawbacks. First, cleaning a club face with a wet towel tends to quickly ruin the towel and does not insure that each entire groove of the club face is cleaned. Also, the golfers' hands become wet, which might interfere with the gripping of the club. Likewise, scraping the grooves with a tee does not insure that all dirt and grass are removed from the club face and the scraping action might also damage the club face. Although carbide-tipped scrapers are effective in cleaning the club face and grooves, they tend to wear off the protective finish of the club face, thereby causing the club face to become pitted or rusted. Furthermore, these various types of scrapers tend to become easily lost or misplaced.

Manually-operated brush devices are also available and are typically installed at the golf course on the first tee. However, these manual devices are of no use out on the golf course when a club is used repeatedly. Additionally, other portable manual brush devices tend to require a large amount of exertion by the golfer, thereby causing the golfer to prematurely tire while playing a round of golf.

Based upon the foregoing, it is evident that there is a need in the art for a convenient and easy-to-use portable golf club cleaner. Furthermore, there is also a need in the art for a portable golf club cleaner that is easily secured to a golf bag or golf cart and wherein the parts of the golf club cleaner can be easily replaced.

DISCLOSURE OF INVENTION

In light of the foregoing, it is a first aspect of the present invention to provide a portable golf club cleaner.

Another aspect of the present invention is to provide a portable golf club cleaner for cleaning a club face where a brush is rotated on the club face while a cleaning solution is sprayed thereon.

Still a further aspect of the present invention is to provide a portable golf club cleaner where the brush is rotated and the cleaning solution is sprayed when the club face comes in contact with the brush.

An additional aspect of the present invention is to provide a portable golf club cleaner wherein the cleaning solution is collected after use and recirculated for additional club face cleanings.

Yet an additional aspect of the present invention is to provide a portable golf club cleaner wherein the cleaning solution is prevented from coming into contact with electrical components of the cleaning device.

A further aspect of the present invention is to provide a portable golf club cleaner wherein the brush is carried by a pivotable housing so that when the brush is contacted, the housing engages a switch to rotate the brush and spray cleaning solution on the club face.

Another aspect of the present invention is to provide a portable golf club cleaner wherein a power supply can be a rechargeable set of batteries or the battery from an electric golf cart.

Yet a further aspect of the present invention is to provide a portable golf club cleaner that is small in size and easy to transport.

The foregoing and other aspects of the invention which shall become apparent as the detailed description proceeds are achieved by a portable golf club cleaner for cleaning a club face, comprising: a selectively operable brush; a selectively operable pump; and a power supply for rotating the brush and for operating the pump to supply a cleaning solution to a club face while the brush rotates upon the club face.

The present invention also provides a portable golf club cleaner for cleaning a club face, comprising: a cleaner housing; a rotatable brush carried by the cleaner housing; a recirculating pump in communication with a reservoir holding a supply of cleaning solution, the recirculating pump and the reservoir carried by the cleaner housing; and a power supply operative with the rotatable brush and the recirculating pump, wherein the rotatable brush is rotated by the power supply and wherein the recirculating pump sprays the cleaning solution onto the club face only when the club face is in contact with the rotating brush.

BEST MODE FOR CARRYING OUT THE INVENTION

Figure 1:
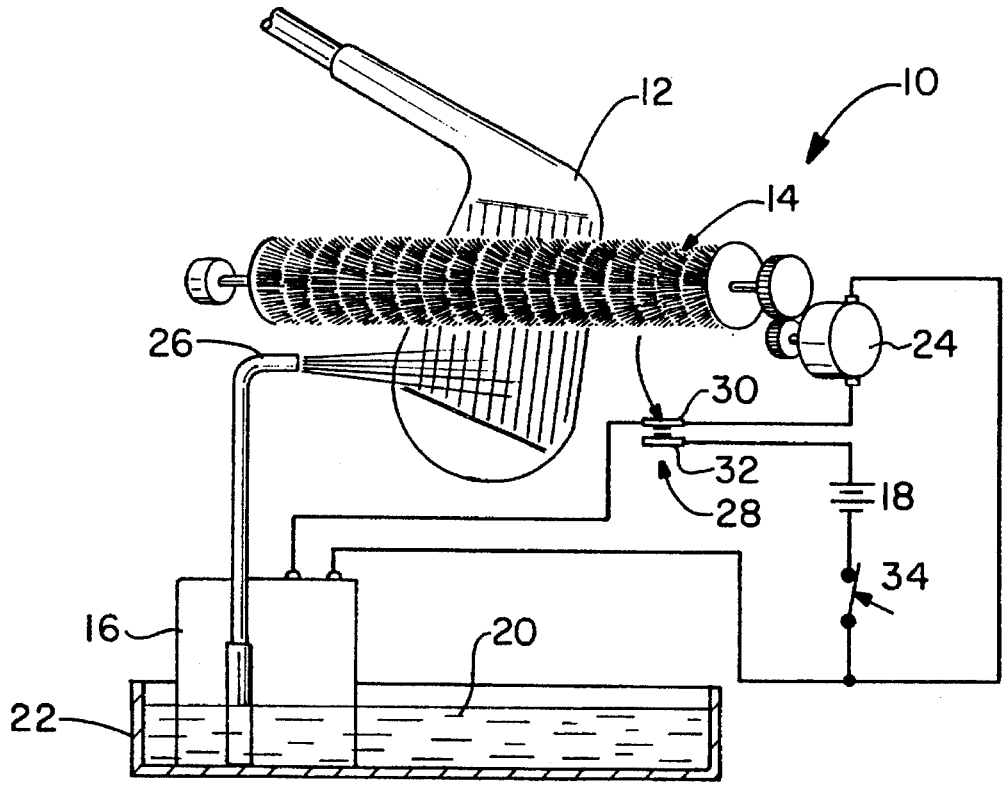
FIG. 1 is a schematic diagram illustrating the operation of a portable golf club cleaner.

Referring now to the drawings, and more particularly to FIG. 1, it can be seen that a portable golf club cleaner, according to the present invention, is designated generally by the number 10. Generally, the portable golf club cleaner 10 receives a golf club face 12 against a selectively operable brush 14, and in close proximity to a selectively operable recirculating pump 16. A power supply 18 provides power to rotate the brush 14 and operate the pump 16. The pump 16 supplies a cleaning solution 20 to the club face 12 while the brush 14 rotates upon the club face 12. The drawings are exemplary of a portable golf club cleaning device 10 which can be used to clean either golf irons or golf woods. Furthermore, the portable golf club cleaner 10 can be constructed in various sizes to meet particular needs. Additionally, the cleaning solution 20 may either be water, a detergent-based liquid, or any other type solution found effective in cleaning the face of a golf club.

In particular, the brush 14 is rotated by a motor 24 while the pump 16 recirculates the cleaning solution 20 from a removable reservoir 22, which has connection tabs 23, to a spray nozzle 26 that is in close proximity to the club face 12. In the preferred embodiment, the pump 16 employed is commercially available from Edmond Scientific of New Jersey, as part number 50345. The portable golf club cleaner 10 is controlled by an activation switch 28 that is in a normally open condition. The activation switch 28, which has a movable contact 30 in operative relationship with a stationary contact 32, when engaged provides power from the power supply 18 to the motor 24 and the recirculating pump 16. A spray switch 34, which is in a normally closed condition, is also provided by the golf club cleaner 10 for controlling the recirculation of the cleaning solution 20 from the pump 16 to the spray nozzle 26. Those skilled in the art will appreciate that the spray switch 34 must be in a closed position for both the brush 14 and the pump 16 to operate.

Figure 2:
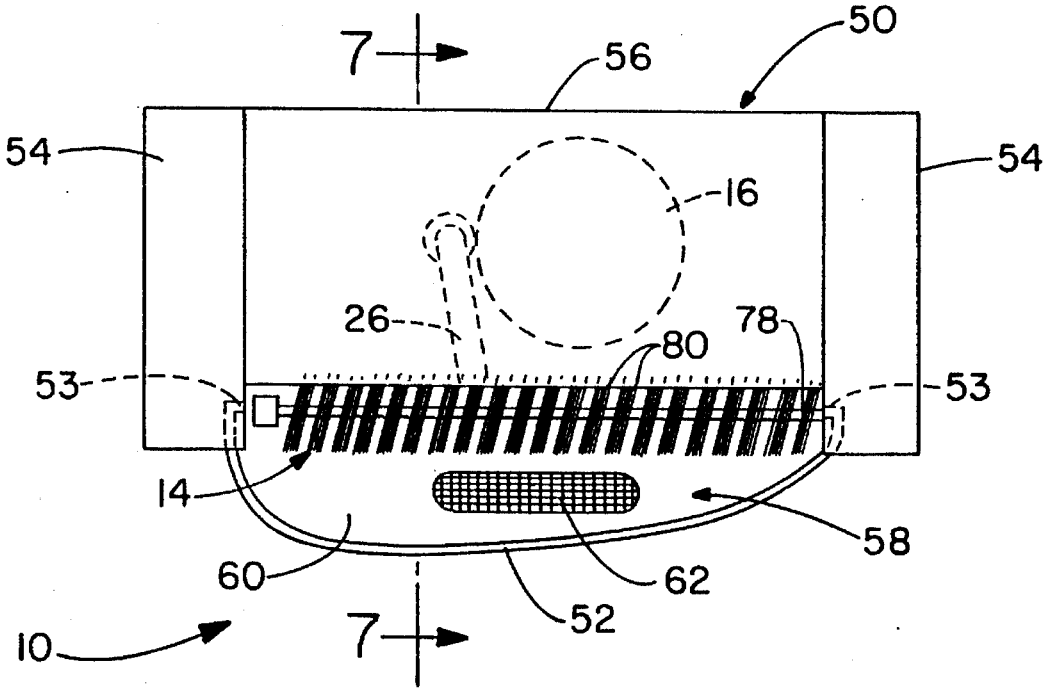
FIG. 2 is a top plan view of a portable golf club cleaner according to the present invention.

FIG. 2 illustrates the housing 50 of the portable golf club cleaner 10. The cleaner housing 50 has a detachable front cover 52, with spring latches 53, secured between ends of a brush housing 54. A brush housing cover 56 is disposed on the brush housing 54 opposite the front cover 52. Of course, the brush housing 54 holds therebetween the partially exposed rotatable brush 14. The rotatable brush 14 and the front cover 52 define a club face opening 58 which receives the golf club face 12 to be cleaned. The front cover 52 is tapered such that the club face opening 58 is narrow at one end of the brush housing 54 and wider at the opposite end. By tapering the club face opening 58 in such a manner, full insertion of the club face 12 into the opening is permitted. This allows the brush 14 to access and clean all of the grooves on the club face in an efficient manner. At the bottom of the club face opening 58 is a collector 60 which extends inwardly from the front cover 52. The collector 60 has a filter screen 62 which is disposed over the top of the reservoir 22 for receiving used cleaning solution 20. The reservoir 22 is detachable from the housing 50 to allow for easy replacement of the cleaning solution 20 and to allow for the removal of any unfiltered sediment contained therein.

Figure 3:
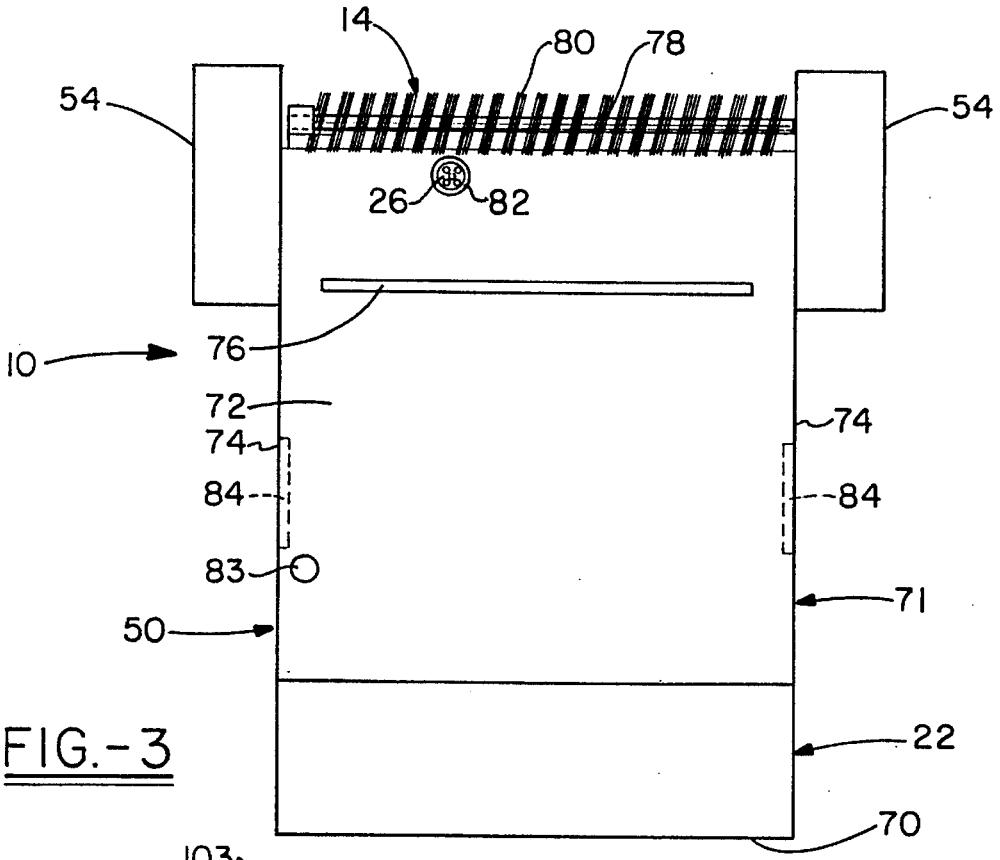
FIG. 3 is a front elevational view of a portable golf club cleaner with a detachable front cover removed.
Figure 4:
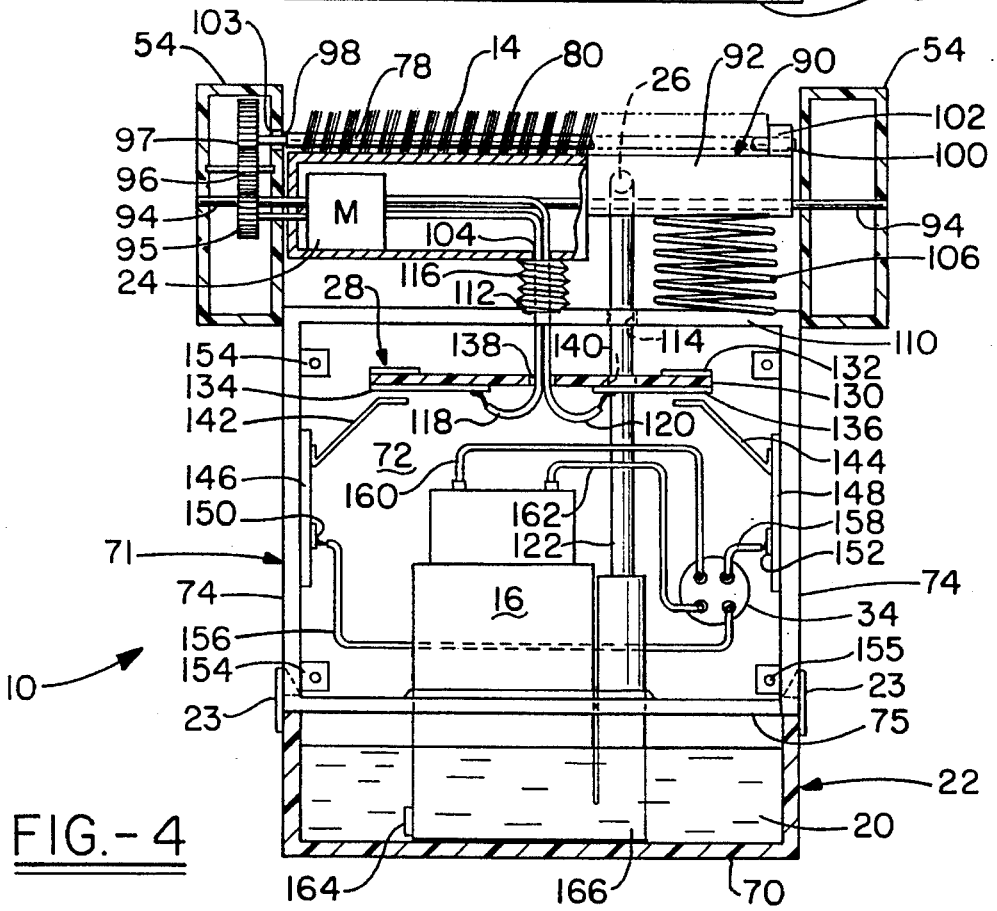
FIG. 4 is a rear elevational view in cross-section illustrating the operational components of the present invention.
Figure 7:
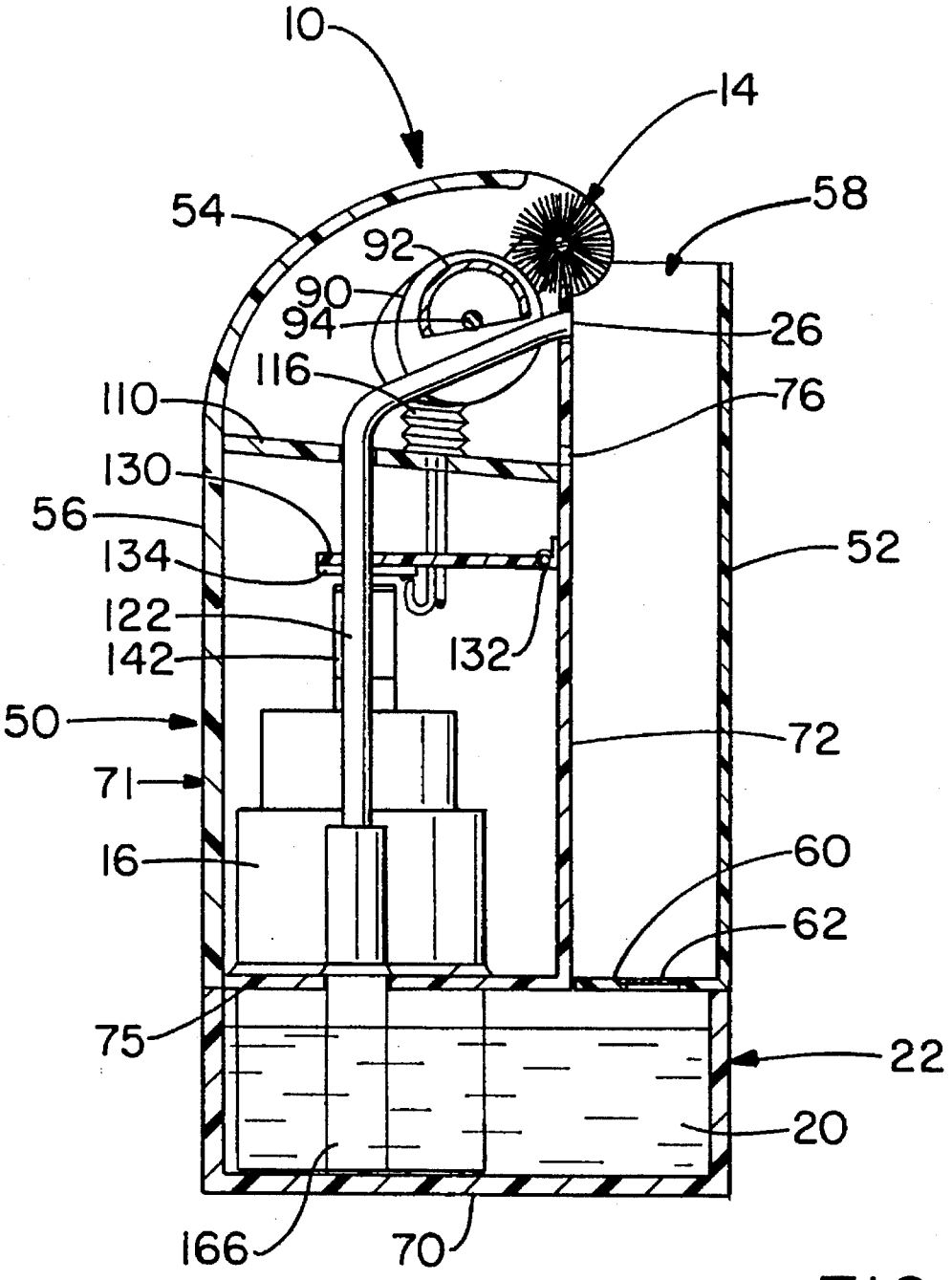
FIG. 7 is a side elevational view, partially broken away, of the portable golf club cleaner.

Referring now to FIGS. 3, 4 and 7, it can be seen that the portable golf club cleaner 10, with the detachable front cover 52 removed, has a base 70 which supports a compartment 71. The compartment 71 has a front wall 72, sidewalls 74, and a compartment base 75. The sidewalls 74 support each end of the brush housing 54. The compartment base 75 supports the front wall 72 and the sidewalls 74 and encloses the reservoir 22. The pump 16 is secured and sealed to the base 75 by a water tight adhesive or other similar means. The front wall 72 provides a drainage slot 76 which directs used cleaning solution contained within the brush housing 54 toward the reservoir 22. FIG. 3 also shows that the brush housing 54 rotatably supports the brush 14. The brush 14 has a brush axle 78 that supports a plurality of bristles 80. The front wall 72 provides a nozzle hole 82 through which the spray nozzle 26 extends into the club face opening 58. The front wall 72 also has an opening 83 for the spray switch 34. Whenever the detachable front cover 52 is secured to the front wall 72 the spray switch 34 is closed. The side walls 74 have notches 84 for receiving the spring latches 53. In a similar manner, the connection tabs 23 are also detachably received by the sidewalls 74. The front cover 52 is attached and detached from the cleaner housing by manipulating the spring latches 53 into and out of the notches 84. Of course, the reservoir 22 and the front cover 52 can be detachably mounted to the compartment 71 in any manner known to those skilled in the art. Moreover, the front cover 52 provides a water tight seal around the housing 50 except of course for the club face opening 58.

A brush assembly 90 is contained within the brush housing 54. In particular, the brush assembly 90 has a cylindrical housing 92 which is rotatably mounted on a cylindrical housing axle 94. Those skilled in the art will appreciate that the cylindrical housing axle 94 is secured at both ends to the brush housing 54. One end 98 of the brush 14 is secured to a motor gear 95 which is driven by the motor 24. Gear 95 is meshed with an intermediate gear 96 which is meshed with a brush gear 97 to obtain the optimum rotational speed of the brush 14. The opposite end of the brush axle 78 is a float end 100 that rotates within a brush bushing 102. The brush bushing 102 is contained within and secured to the cylindrical housing 92. The brush housing 54 may have an appropriately shaped opening 103 or other appropriate means to allow the movement of the brush axle 78 and movement of the axle which connects the gear 95 to the motor 24 when the brush 14 is contacted by a club face.

The cylindrical housing 92 has a wire aperture 104 that extends through the bottom portion thereof. A cylindrical spring 106 is disposed on a drain board 110 and supports the cylindrical housing 92. The drain board 110 separates the brush assembly 90 from the compartment 71. Moreover, the drain board 110 is directed downwardly so that any excess cleaning solution 20 is directed toward the drainage slot 76. The drain board 110 has a spring aperture 112 and a nozzle aperture 114. A covered spring 116 is disposed between the wire aperture 104 and the spring aperture 112 so as to receive a positive motor lead 118 and a negative motor lead 120. Motor leads 118 and 120 are insulated solid 18 AWG wires. The positive motor lead 118 and negative motor lead 120 are connected at one end to the appropriate terminals of the motor 24 which is contained within the brush assembly 90. The nozzle aperture 114 receives a spray hose 122 which interconnects the recirculating pump 16 to the spray nozzle 26. Those skilled in the art will appreciate that the covered spring 116 and the spray hose 122 are sealed with respect to the drain board 110 such that the cleaning solution 20 is precluded from entering any of the components contained within the compartment 71.

The movable contact 30 includes a hinge plate 130 which is biasingly supported by a spring hinge 132 at one end, while the opposite end of the spring hinge is secured to the front wall 72. As will be discussed in further detail below, the solid wire motor leads 118 and 120 move the hinge plate 130 as the cylindrical housing 92 is rotated. The underside of hinge plate 130 has a conductive covering 134 at one end isolated from a conductive covering 136 at an opposite end. The hinge plate 130 also has a wire notch 138 and a hose notch or hole 140. The positive motor lead 118 and the negative motor lead 120 are directed downwardly from the spring aperture 112 through the wire notch 138. The positive motor lead 118 is electrically connected to the first conductive covering 134, and the negative motor lead 120 is electrically connected to the second conductive covering 136. The spray hose 122 is received within the hose notch 140 and is positioned such that it does not interfere with the movement of the hinge plate 130.

The stationary contact 32 includes a spring contact 142 and a spring contact 144. The spring contact 142 is electrically connected to a terminal connection 146 which is disposed on the inner surface of the sidewall 74. In a similar fashion, the spring contact 144 is electrically connected to a terminal connection 148 which is disposed on the opposite inner surface of sidewall 74. The spring contacts 142 and 144 are positioned such that they come in contact simultaneously with their respective conductive coverings 134 and 136 whenever the hinge plate 130 is moved downwardly by the motor leads 118 and 120.

A positive battery tab 150 extends outwardly from the terminal connection 146. Likewise, a negative battery tab 152 extends outwardly from the terminal connection 146. As will be discussed hereinbelow, the battery tabs 150 and 152 provide a connection to the power supply 18. Attachment tabs 154, with holes 155, extend inwardly from the sidewalls 74.

Electrically connected to the terminal connection 146 is a lead 156 which is connected to the spray switch 34. In a similar manner, a lead 158 is electrically connected from the terminal connection 148 to the spray switch 34. A lead 160 is electrically connected from one terminal of pump 16 to the spray switch 34. And in a similar fashion, a lead 162 is electrically connected from another terminal of pump 16 to the spray switch 34.

The compartment base 75 receives the recirculating pump 16 in such a manner that the terminal connections of the recirculating pump 16 are contained within the compartment 71 and the lower portion of the recirculating pump is contained within the reservoir 22. The recirculating pump 16 has a pump inlet 164 for receiving the cleaning solution 20 and a pump outlet 166 for directing the cleaning solution 20 through the spray hose 122 to the spray nozzle 26.

Figure 5:
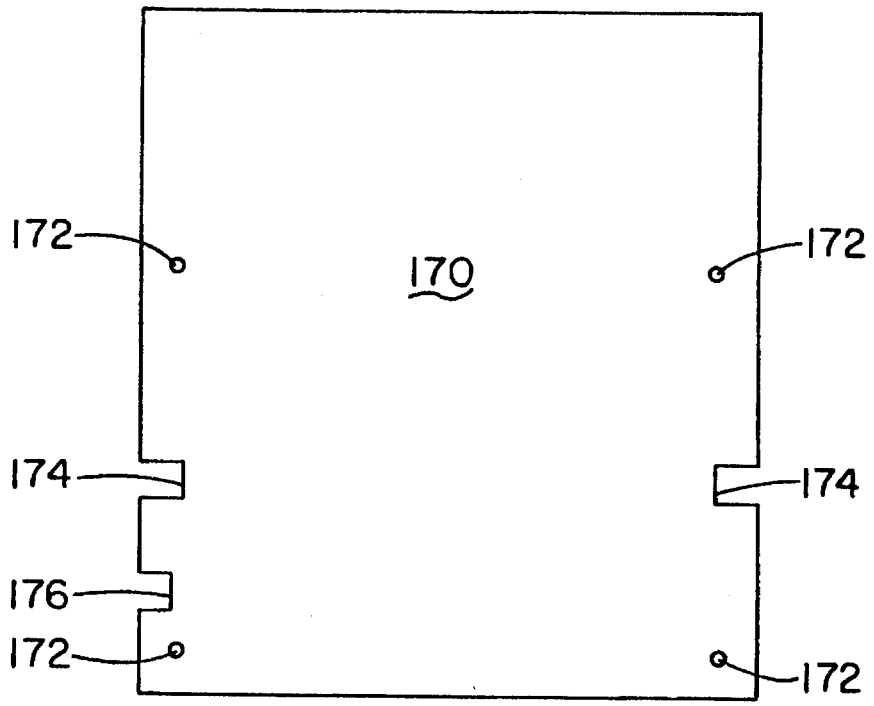
FIG. 5 is a front elevational view of a compartment cover which is employed in the present invention.

Referring now to FIGS. 4 and 5, it can be seen that a compartment cover 170 has attachment holes 172 that are aligned with the attachment holes 155 for securing and sealing the compartment cover 170 thereto. The compartment cover 170 also has tab openings 174 which are sized to fit around the outwardly extending battery tabs 150 and 152. The compartment cover 170 also has an attachment notch 176 for receiving the power supply 18.

Figure 6:
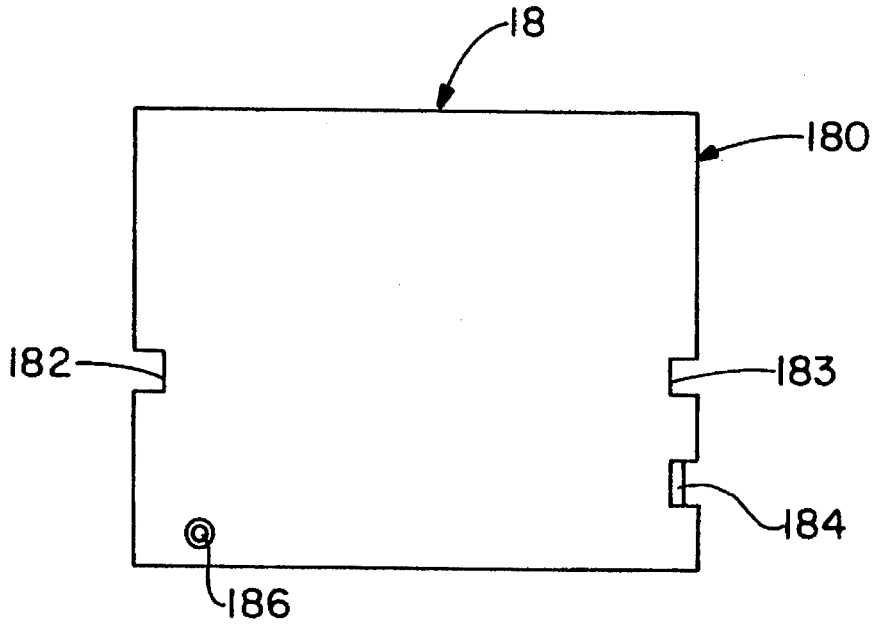
FIG. 6 is a rear elevational view of a battery pack that is disposed on the compartment cover of the present invention.

Referring now to FIGS. 4, 5 and 6, it can be seen that the power supply 18 can be in the form of a battery pack 180. The battery pack 180 has a positive battery terminal 182 and a negative battery terminal 183. The battery pack 180 also has an attachment latch 184 and a recharge receptacle 186. Those skilled in the art will appreciate then that the battery pack 180 is connected over the compartment cover 170 by inserting the attachment latch 184 into the attachment notch 176. When the battery pack 180 is secured to the compartment cover 170, the battery terminal 182 is placed in electrical contact with the positive battery tab 150. In a similar fashion, the negative battery terminal 183 is placed in an electrical connection with the negative battery tab 152. In the preferred embodiment, the battery pack 180 is made up of at least five 6.2-volt batteries connected in parallel. Moreover, it will be appreciated that these batteries are rechargeable through the recharge receptacle 186 by a recharger.

Referring now to all the drawings, the operation of the portable golf club cleaner 10 will be discussed. In operation, the compartment cover 170 is installed onto the attachment tabs 154 to completely enclose the compartment 71. Afterwards, the battery pack 180 is secured over the compartment cover 170 to provide electrical power to the motor 24 and the recirculating pump 16. Those skilled in the art will appreciate that the power supply 18 could also be provided by a battery contained within an electric golf cart. The detachable front cover 52 is secured to the golf club cleaner 10 by inserting spring latches 53 into notches 84 so as to provide the club face opening 58. The installation of the front cover 52 functions to close the spray switch 34 so that a continual supply of cleaning solution 20 may be sprayed whenever the activation switch 28 is engaged.

After a golfer has used a golf club, he or she inserts the club head into the club face opening 58. As the club face 12 comes in contact with the rotatable brush 14, the brush axle 78 is moved so as to also move the brush assembly 90. The brush assembly 90 includes a cylindrical housing 92, a cylindrical housing axle 94, the motor 24, the brush bushing 102, and the positive motor lead 118 and negative motor lead 120. The brush assembly 90 is supported by the cylindrical housing axle 94 which is secured at each of its ends to the brush housing 54. Thus, as the club face 12 moves the brush axle 78, the cylindrical housing 92 is also moved or slightly rotated in a corresponding fashion. The cylindrical housing 92 is supportingly biased by the cylindrical spring 106 and the covered spring 116 which are supported by the drain board 110. Received within the covered spring 116 are the positive and negative motor leads 118 and 120, respectively which move as the cylindrical housing 92 is moved. The positive and negative motor leads 118 and 120 are directed through the spring aperture 112 and through the wire notch or hole 138 of the hinge plate 130.

The hinge plate 130, which is a part of the movable contact 30, is biasingly secured to the front wall 72 by spring hinge 132. In the preferred embodiment, the conductive coverings 134 and 136, which are adhesive-backed brass, are secured to the underside of the hinge plate 130. As best seen in FIG. 4, the solid motor leads 118 and 120 are respectively electrically connected to the conductive coverings 134 and 136. Therefore, as the cylindrical housing 92 is rotated upon the cylindrical axle 94 by the club face 12, the solid motor wire leads 118 and 120 force the hinge plate 130 downwardly so that the conductive coverings 134 and 136 come in contact with respective spring contacts 142 and 144, thus completing the circuit for operation of the golf club cleaner. As such, electrical power is provided to the motor 24 for rotating the gear 96 and the brush axle 78. Simultaneously, electrical power is also supplied to the recirculating pump 16 which intakes the cleaning solution 20 and propels it through the spray hose 122 out the spray nozzle 26 onto the club face 12.

Thus, it will be appreciated as the brush rotates upon the club face 12, cleaning solution 20 is also supplied to the club face 12. Any cleaning solution 20 that is not directed onto the club face 12 combines with all the solution that drips off the club face and proceeds down the outer surface of the front wall 72, through the filter screen 62 and into the reservoir 22 for reuse. Additionally, any cleaning solution 20 retained within the brush assembly 90 or cylindrical housing 92 is directed onto the top of the drain board 110 and directed downwardly through the drainage slot 76 into the reservoir 22 for reuse.

If a golfer desires to clean the club face of a driver, it will be appreciated that the detachable front cover 52 is removed so that the club face 12 can access the brush 14. In order to properly operate the portable golf club cleaner 10 in this mode, it is required that the golfer depress the spray switch 34 manually to control the operation of the recirculating pump 16.

It is apparent then from the above description of the structure and operation of the portable golf club cleaner 10 that the problems associated with the prior devices for cleaning golf club faces have been overcome. The golf club cleaner 10 is sized such that it can be carried in one hand with ease. In particular, the portable golf club cleaner 10 provides a compact and easily-moved cleaning device that can be attached to and detached from either a golf bag, pull cart, an electric golf cart or any other similar device. It will also be appreciated that since the portable golf club cleaner 10 is electrically powered, the golfer is not required to overexert himself during a round of golf.

A further advantage of the present invention is that the device is operated in a "hands off" manner. In other words, all that is required to engage the portable cleaning device 10 is to press the golf club face 12 onto the brush 14 so as to engage the activation switch 28. This provides a simple and effective method of cleaning a golf club face without requiring the golfer to expose his or her hands to the cleaning solution and/or foreign matter disposed on the club face.

Yet another advantage of the present invention is that the cleaning solution is recirculated throughout the device. In other words, the recirculating pump 16 can receive any used cleaning solution 20 through the filter 62 and reuse the solution to clean multiple club faces. Furthermore, the structure of the present invention is such that the cleaning solution can be replaced after each round of golf so as to maintain the quality and effectiveness of the cleaning device. Moreover, the structure of the present invention is such that the cleaning solution 20 is precluded from coming into contact with the electrical components of the device.

Thus, it can be seen that the objects of the invention have been satisfied by the structure presented above. It should be apparent to those skilled in the art that the objects of the present invention could be practiced with any type of electrical power supply, including that of an electric golf cart, and can be adapted to be affixed to either an electric golf cart or a golf bag.

While the preferred embodiment of the invention has been presented and described in detail, it will be understood that the invention is not limited thereto or thereby. As such, various materials and configurations may be used in the construction of the invention to meet the various needs of the consumer. Accordingly, for an appreciation of true scope and breadth of the invention, reference should be made to the following claims.

What is claimed is:

1. A portable golf club cleaner for cleaning a club face, comprising:

a selectively operable brush;

a selectively operable pump connected to a spray hose having a nozzle;

a power supply for rotating said brush and for operating said pump to supply a cleaning solution to said nozzle and onto a club face while said brush rotates upon the club face;

a switch activated by said club face coming in contact with said brush, said switch controlling the delivery of power from said power supply;

a cleaner housing for receiving said pump, said cleaning solution and said switch; and a brush assembly received within said cleaner housing, said brush assembly including said brush, a cylindrical housing which is movable upon an axle carried by said cleaner housing, said cylindrical housing supporting a motor for rotating said brush, and said brush assembly connected to and moving a hinge plate whenever the club face comes in contact with said brush, said hinge plate contacting a pair of spring contacts, wherein said hinge plate and said pair of spring contacts form said switch.

2. The portable golf club cleaner, according to claim 1, wherein said cleaner housing has a reservoir for holding said cleaning solution, and wherein said brush assembly is supported by a drain board so that used portions of said cleaning solution are directed by said drain board through a filter screen to said reservoir.

3. The portable golf club cleaner according to claim 2, further comprising a cover detachable from said cleaner housing, said cover and said cleaner housing forming a club face opening for receiving said club face, and said cover having said filter screen.

4. The portable golf club cleaner according to claim 3, further comprising:

a pair of battery tabs, each battery tab connected to one of said contact springs, each said battery tab mateable with respective battery terminals of a battery pack which is detachable from said cleaner housing.

5. The portable golf club cleaner according to claim 4, further comprising:

a spray switch for controlling the flow of cleaning solution from said pump, wherein said spray switch must be in a closed position for both said brush and said pump to operate.

6. A portable golf club cleaner for cleaning a club face, comprising:

means for rotating a brush against a club face;

means for spraying a cleaning solution onto said club face as said brush rotates, wherein said rotating means and said spraying means operate only when said club face is in contact with said brush;

means for activating said rotating means and said spraying means, said activating means controlling the delivery of power from a power supply to said spraying means and said rotating means; and a cleaner housing receiving said rotating means, said spraying means, said activating means, said power supply and a brush assembly, wherein said brush assembly carries said brush, and wherein said brush assembly is rotatable upon an axle secured to said cleaner housing.

7. The portable golf club cleaner, according to claim 6, wherein said activating means has a movable contact controlled by the movement of said brush assembly so the movable contact closes upon a stationary contact only when said club face is in contact with said brush.

8. The portable golf club cleaner according to claim 7, further comprising:

means for biasing said brush assembly to resist the movement thereof when said club face comes in contact with said brush, said biasing means supported by a drain board so that any excess cleaning solution is redirected to a reservoir.

9. The portable golf club cleaner according to claim 8, further comprising:

a spray switch, actuated by a cover detachable from said cleaner housing, wherein said spray switch must be closed by said cover for both said brush and said pump to operate.

10. The portable golf club cleaner according to claim 9, wherein said power supply is carried by said cleaner housing.

11. A portable golf club cleaner for cleaning a club face, comprising:

a cleaner housing;

a rotatable brush carried by a cylindrical housing that is pivotable upon an axle secured to said cleaner housing;

a recirculating pump in communication with a reservoir holding a supply of cleaning solution, said recirculating pump and said reservoir carried by said cleaner housing;

a power supply operative with said rotatable brush and said recirculating pump;

a switch in a normally open position and interconnecting said power supply to said rotatable brush and said recirculating pump when said switch is closed, said switch only closing when said rotatable brush is impacted by a club face to pivot said cylindrical housing; and wherein said rotatable brush is rotated by said power supply and wherein said recirculating pump is energized by said power supply and sprays said cleaning solution onto said club face when said switch is closed.

12. The portable golf club cleaner according to claim 11, wherein said brush is rotated by a motor connected to said power supply.

13. The portable golf club cleaner according to claim 12, wherein said cylindrical housing is connected to a movable contact that is receivable by a stationary contact, so that when said club face contacts said brush, said cylindrical housing is moved to place said movable contact in an operative relationship with said stationary contact, thus providing power from said power supply to both said motor and said recirculating pump.

14. The portable golf club cleaner according to claim 13, wherein said movable contact is a hinge plate pivotable with respect to said cleaner housing, said hinge plate connected to said cylindrical housing by a pair of solid insulated motor leads, wherein said motor leads are connected at one end to said motor and at their opposite ends to respective first and second conductive coverings disposed on said hinge plate for moving said hinge plate in contact with said stationary contacts.

* * * * *